US009048007B2

(12) United States Patent
Hailong et al.

(10) Patent No.: US 9,048,007 B2
(45) Date of Patent: Jun. 2, 2015

(54) SEPARATOR STRUCTURE FOR CAT 6 CABLE

(75) Inventors: Xu Hailong, Shangai (CN); Youbing Li, Shangai (CN)

(73) Assignee: NEXANS, Paris (FR)

( * ) Notice: Subject to any disclaimer, the term of this patent is extended or adjusted under 35 U.S.C. 154(b) by 849 days.

(21) Appl. No.: 12/741,449

(22) PCT Filed: Dec. 1, 2008

(86) PCT No.: PCT/CN2008/073268

§ 371 (c)(1),
(2), (4) Date: Oct. 15, 2010

(87) PCT Pub. No.: WO2009/074087

PCT Pub. Date: Jun. 18, 2009

(65) Prior Publication Data

US 2011/0017492 A1 Jan. 27, 2011

(30) Foreign Application Priority Data

Nov. 30, 2007 (CN) ..... 2007 1 0171555

(51) Int. Cl.
*H01B 11/02* (2006.01)
*H01B 7/18* (2006.01)
*H01B 11/06* (2006.01)

(52) U.S. Cl.
CPC ..... *H01B 7/1895* (2013.01); *H01B 11/06* (2013.01)

(58) Field of Classification Search
USPC ..... 174/113 R, 113 C
See application file for complete search history.

(56) References Cited

U.S. PATENT DOCUMENTS

| | | | | |
|---|---|---|---|---|
| 3,848,073 | A * | 11/1974 | Simons et al. | 174/36 |
| 6,288,340 | B1 * | 9/2001 | Arnould | 174/113 R |
| 6,300,573 | B1 | 10/2001 | Horie et al. | |
| 6,566,605 | B1 * | 5/2003 | Prudhon | 174/113 C |
| 7,834,271 | B2 * | 11/2010 | Gromko et al. | 174/113 R |
| 2004/0026113 | A1 * | 2/2004 | Bahlmann et al. | 174/113 C |

FOREIGN PATENT DOCUMENTS

| | | |
|---|---|---|
| CN | 201126738 | 10/2008 |
| JP | 56-36609 | 4/1981 |
| JP | 56036609 | 4/1981 |

OTHER PUBLICATIONS

International Search report dated Mar. 19, 2009.
International Search Report dated Jan. 7, 2013.

* cited by examiner

*Primary Examiner* — Chau N Nguyen
(74) *Attorney, Agent, or Firm* — Sofer & Haroun, LLP

(57) ABSTRACT

A separator structure for Cat 6 cable has a core (2); a shield layer (1) between the core (2) and a jacket, or a jacket (1); four conductor sets (3) each consisting of a pair of conductors (21), and insulating layers (22) covering the conductors provided inside the core (2); and a separator (25) among the four conductor set (3). The separator (25) has a shape of "V", the bottom end of which is located at the center of the core (2) and the two sides of which respectively separate the adjacent conductor sets (3) from each other.

2 Claims, 3 Drawing Sheets

SEPARATOR STRUCTURE FOR CAT 6 CABLE

RELATED APPLICATION

This application is a National Phase Application of PCT Patent Application No. PCT/CN2008/073268 which in turn claims the benefit of priority from Chinese Patent Application No. CN 200710171555.2, filed on Nov. 30, 2007—30 Nov. 2007

TECHNICAL FIELD

This disclosure relates to a Cat 6 cable and, more particularly, to a separator structure for the Cat 6 cable.

BACKGROUND

Generic cabling system provides modularized and flexible channels for information transmission within or between buildings. It not only connects audio, data, image devices, information exchange devices and other information management systems with each other, but also connects such devices to external communication network. It also includes all the cables between the wiring network or telecommunication circuitry outside the buildings and application system devices, and related connection elements. Generic cabling system consists of various kinds and types of elements, including transmission media, related connection hardware (e.g. distribution frame, connector, socket, plug, adapter), electrical protection equipments and so on, which elements can serve to construct various wiring sub-systems and have their own specific usage. In addition, these elements are easy to install and can be updated smoothly according to the varying requirement.

However, with time going by and the change of network application, it is believed that cabling system is the base of intelligent design, which is closely related with information network and focuses on building up the multimedia integrated network, such as telephone, data, text, image transmission and so on. The performance gradation and criterion of the cabling system are continuously improved and updated along with the development of network communication technology, and at present the performance gradation mainly involves CAT 5E (100 MHz) cable, CAT 6 (250 MHz) cable and optical fiber.

CAT 6 (250 MHz) cable is becoming the mainstream product in the generic cabling market, which is generally of the shielded and unshielded type.

As shown in FIG. 1, more than 90% of the CAT 6 cables in prior art are manufactured employing a cross-shaped separator as the filler in the cable.

In FIG. 1, it shows a core 2, and a shield layer 1 between the core 2 and a jacket (not shown), or a jacket 1; inside the core 2, it is provided with four conductor sets (twisted pairs) 3 each consisting of a pair of conductors (wires) 21, insulating layers 22 covering the conductors, and a cross-shaped separator 23 among the four twisted pairs 3.

As shown in FIG. 2, a minority of the CAT 6 cables in prior art are manufactured employing a flat-strip separator as the filler in the cable.

In FIG. 2, it shows a core 2, and a shield layer 1 between the core 2 and a jacket (not shown), or a jacket 1; inside the core 2, it is provided with four conductor sets (twisted pairs) 3 each consisting of a pair of conductors 21, insulating layers 22 covering the conductors, and a flat-strip separator 23 among the four twisted pairs 3.

However, the filler solutions as described above inevitably present following unresolved technical problems:

As for the ordinary cross-shaped separator: the cable is large in wire diameter, not flexible enough (exhibiting an inherent stiffness caused by the cross), and unable to be packaged using the cross-spool winding system (Reelex), which renders difficulty in packaging and transporting;

As for the flat-strip separator: the cable is small in wire diameter and flexible, but unstable in structure, and also unable to be packaged using the cross-spool winding system (Reelex), which renders difficulty in packaging and transporting and unreliability in installation.

SUMMARY

An object of the present utility model is to propose a separator structure of CAT 6 cable, which overcomes the aforementioned problems.

To solve the abovementioned problems, the separator structure according to present utility model comprises a core; a shield layer between the core and a jacket, or a jacket; four conductor sets (twisted pairs) each consisting of a pair of conductors (wires) and insulating layers covering the conductors provided inside the core; and a separator among the four conductor sets; wherein said separator has a shape of "V", the bottom end of which is located at the center of the core and the two sides of which respectively separate the adjacent conductor sets.

The present design has such advantages over the prior art that, it is possible to use the cross-spool winding system (Reelex) in packaging as in the case of CAT 5E cable; the old reel-in-box which is necessary for CAT 6 cable package in prior art is omitted; the cable and the package thereof are compacter and lighter; cost for transportation and on-site cabling is highly reduced.

DETAILED DESCRIPTION

The present utility model will be described in detail with reference to the annexed drawings and an embodiment as follows.

Figure 1:
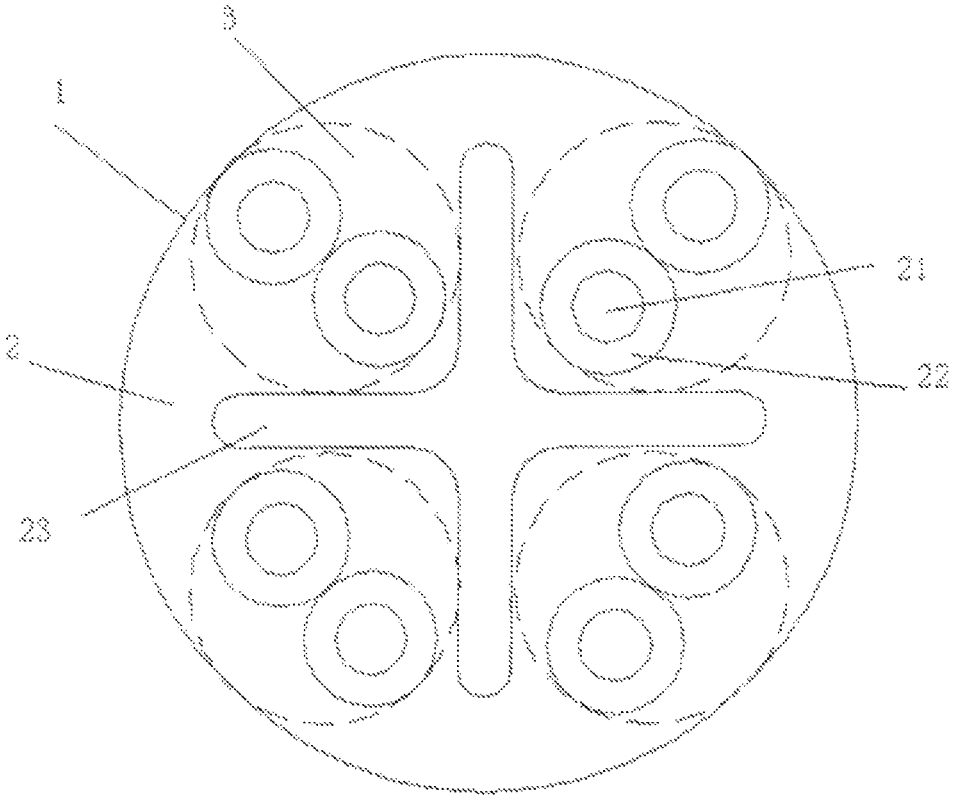
FIG. 1 (PRIOR ART)
FIG. 1 is a schematic diagram of the structure of the CAT 6 STP cable with a cross-shaped separator in prior art.
Figure 2:
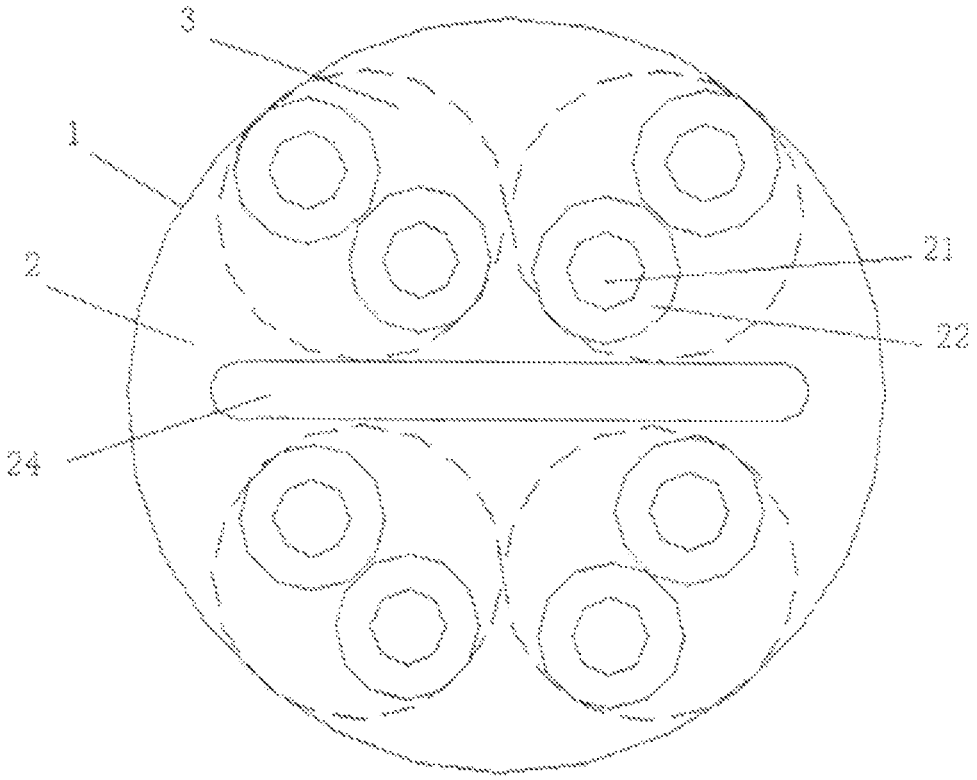
FIG. 2 (PRIOR ART)
FIG. 2 is a schematic diagram of the structure of the CAT 6 STP cable with a flat-strip separator in prior art.
Figure 3:
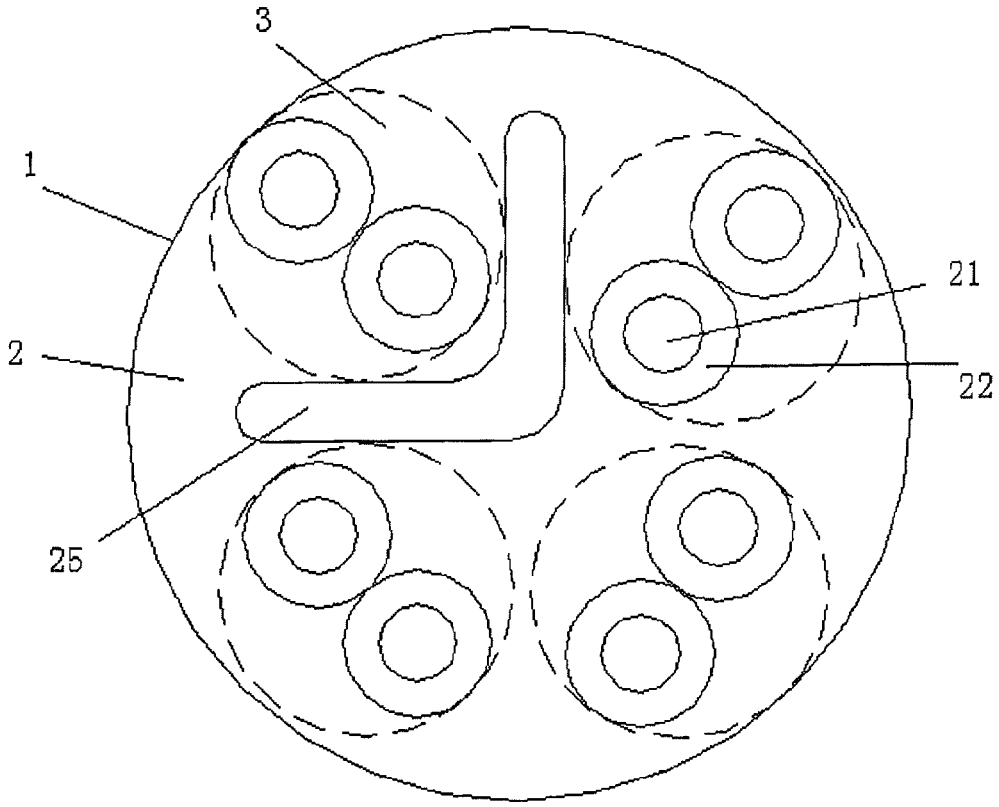
FIG. 3 is a schematic diagram of the structure of the CAT 6 STP cable of the present utility model.

As shown in FIG. 3, the separator structure according to present utility model comprises a core 2; a shield layer 1 between the core 2 and a jacket, or a jacket 1; four conductor sets (twisted pairs) 3 each consisting of a pair of conductors (wires) 21, and insulating layers 22 covering the conductors provided inside the core 2; and a separator 25 among the four conductor sets 3; wherein said separator 25 has a shape of "V", the bottom end of which is located at the center of the core 2 and the two sides of which respectively separate the adjacent conductor sets 3 from each other;

One of the two sides of said separator 25 separates the left-hand and right-hand conductor sets 3 from each other, and the other of the two sides of said separator 25 separates the upper-left and lower-left conductor sets 3 from each other.

The V-shaped separator is compact, flexible, light in weight and stable in structure, which makes the cabling easier and more reliable.

In addition, the V-shaped separator has less combustible material, thus improving the fire-resistance and safety level.

As compared with the conventional design with a cross or a flat strip as the separator, it is possible to use the cross-spool winding system (Reelex) in packaging as in the case of CAT 5E and omit the old reel-in-box which is necessary for packaging the CAT 6 cable in prior art. In addition to the lower cost, the new design is also more environment-friendly, because the reel is regarded to be such a kind of package garbage that is difficult to dispose, and the omission of reel eliminates the need of garbage disposal.

The new design makes the cable and the package thereof compacter and lighter, and cost for transportation and on-site cabling is highly reduced.

What is claimed is:

1. A Cat 6 cable, comprising:

a core;

a shield layer between the core and a jacket;

said core having four conductor sets each with a pair of conductors, insulating layers covering the conductors provided inside the core; and a single separator wherein said single separator consists of a singular element disposed among the four conductor sets, wherein said singular element separator has only two sides in the shape of "V", the bottom end of said singular element separator is located at the center of the core and the two sides of which respectively separate adjacent conductor sets from each other.

2. A separator structure for Cat 6 cable as claimed in claim 1, wherein one of the two sides of said separator separates the left-hand and right-hand conductor sets from each other, and the other of the two sides of said separator separates the upper-left and lower-left conductor sets from each other.

* * * * *